United States Patent [19]

Wang

[11] 4,150,499

[45] Apr. 24, 1979

[54] SHOE WITH ATTACHABLE AND INTERCHANGEABLE SKATE ACCESSORIES

[76] Inventor: Tec T. T. Wang, No. 24, 4th Fl., Ren Ai Rd., Sec. 1, Taipei, Taiwan

[21] Appl. No.: 838,943

[22] Filed: Oct. 3, 1977

[51] Int. Cl.[2] ..... A43B 5/04; A43B 3/24

[52] U.S. Cl. ..... 36/115; 36/100

[58] Field of Search ..... 36/100, 101, 115

[56] References Cited

U.S. PATENT DOCUMENTS 3,979,842 9/1976 Texidor ..... 36/115

3,983,643 10/1976 Schreyer et al. ..... 36/115

FOREIGN PATENT DOCUMENTS 2328256 2/1975 Fed. Rep. of Germany ..... 36/115

*Primary Examiner*—Patrick D. Lawson

*Attorney, Agent, or Firm*—Shoemaker and Mattare, Ltd.

[57] ABSTRACT

A shoe adapted for use with a plurality of various attachable and interchangeable skating accessories whereby said accessories may be selectively and removably locked into the sole of said shoe, and whereby certain safety features are provided in the form of front and rear stops for a roller skate.

7 Claims, 7 Drawing Figures

SHOE WITH ATTACHABLE AND INTERCHANGEABLE SKATE ACCESSORIES

BACKGROUND OF THE INVENTION

Conventional shoes designed for selective use as either a shoe or roller skate generally relate to "collapsible" roller skates wherein rollers are provided in preformed depressions in the sole of said shoe and are partially releasable in response to a suitable release means so that at least a portion of each roller will extend from its respective depression, said release means generally serving to support said rollers in the extended position.

The major defect of such constructions is that there is insufficient support to the rollers when in the extended position so that skating tends to be unstable. Also, due to the fact that the total support function is localized to a very small point in the central portion of the shoe body, these skates are not capable of supporting much weight and are therefor suitable only for very young children. For the same reason, these skates are extremely susceptable to malfunctions and damage, and generally provide a very short useful life.

Another defect of such shoe/skate combinations is that the rollers are generally not easily detachable from the shoe body so that when the supportive device fails, the combination becomes useless as either a skate or a shoe.

Yet another defect of such shoe/skate combinations is that as the rollers must be concealable in the body of the shoe and are generally not detachable therefrom, it is not possible to change different types of rollers or other skating accessories to provide a variety of skating effects.

The purpose of the present invention is to improve the above said defects and to provide a shoe with skating accessories that is of a very stable construction and which is far less susceptable to malfunctions, providing a greatly increased useful life.

It is another object of the present invention to provide a shoe and skate combination wherein the skating accessories are easily attachable to and detachable from the shoe so that a variety of skating means are interchangeable for producing different skating effects.

It is yet another purpose of the present invention to provide a shoe and skate combination whereby support is distributed uniformly over the skate means, providing more stability and allowing persons of all ages to use the skate with a minimum chance of malfunction.

It is a further purpose of the present invention to increase the overall safety of a skate and more specifically to provide suitable stops which are located at both the front and rear portions of the skating means in such a way that they will not interfere with the walking function of the shoe when the skating means is removed.

BRIEF DESCRIPTION OF THE DRAWINGS

Other purposes and advantages of a shoe and skate combination according to the present invention will become apparent as it is now described in detail with reference to the appended drawings, wherein.

DETAILED DESCRIPTION OF THE INVENTION

Figure 1:
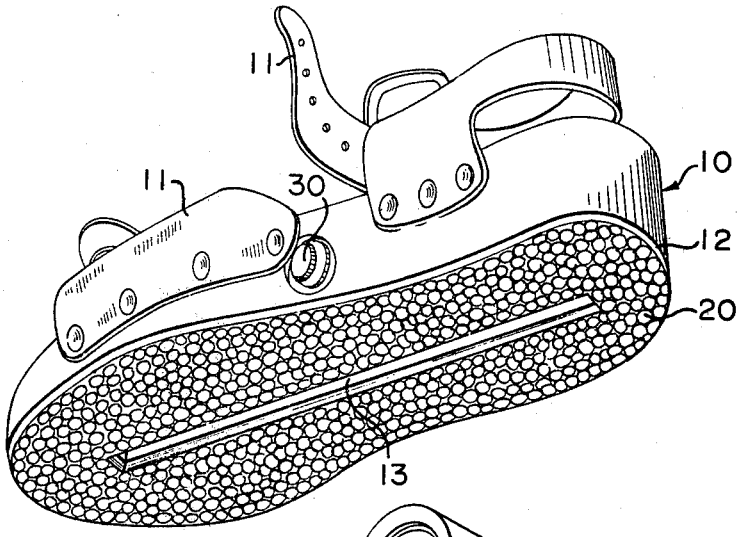
FIG. 1 is a perspective view of a shoe body adapted for receiving and holding various skating means according to the present invention.
Figure 2:
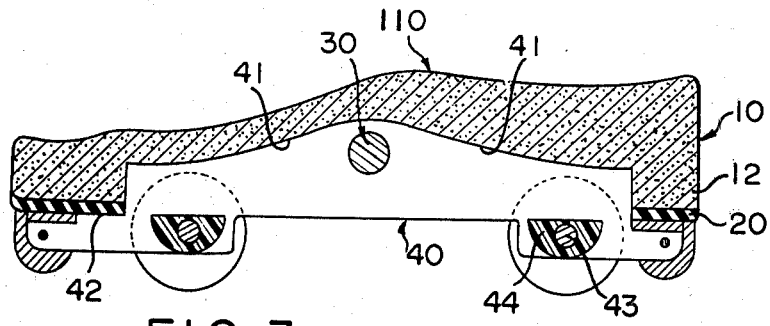
FIG. 2 is a view in partial cross section thereof showing a skating means in place.

Referring to FIGS. 1 and 2, a preferred embodiment according to the present invention includes a shoe body 10 having suitable fastening means 11 for fastening the shoe body 10 to the foot of the user. Along the bottom portion 12 of the shoe body 10 is provided a sole 20 of a suitable material to provide suitable traction when wearing the shoe for the purpose of walking. Along the length of the sole 20 and into the shoe body 10 is a generally arcuate slot 13. The slot 13 runs longitudinaly along the central bottom portion 12 of the shoe body 10 and is spaced from each end of the shoe. As shown in FIG. 2, the top portion 110 of the shoe body 10 may be contoured to provide comfort to the foot of the user.

Figure 3:
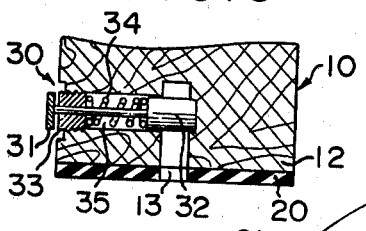
FIG. 3 is a view in cross section of a catch means suitable for use with the present invention.

At a central portion of one side of the shoe body 10 there is provided a suitable catch means 30. As shown in FIG. 3, the catch means comprises a bore 35 through a suitable portion of the shoe body 10 communicative with the longitudinal slot 13. Through said bore is provided a pin 31 and a cylindrical locking member 32. Said locking member 32 is urged into the slot 13 by means of a spring 34 which is biased between a stopper 33 and said locking member. By pulling the pin 31 manually, the locking member 32 will leave the slot 13. In this way the catch means 30 is always in the shoe body 10 and will not be lost or misplaced.

A variety of skating means is provided to be used in conjunction with a shoe of the construction described above, as shown in FIGS. 4A, 4B and 4C.

Figure 4A:
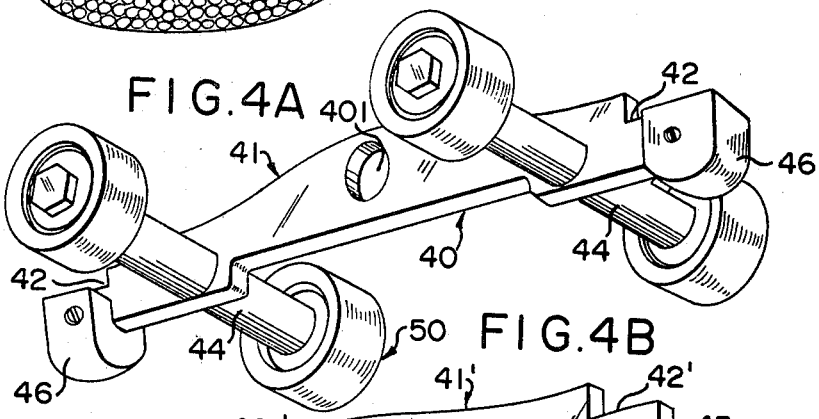
FIG. 4A is a perspective view of a first embodiment of a roller skating means according to the present invention.

With particular reference to FIG. 4A, one embodiment of a skating means includes a set of rollers 50 mounted on a suitable mounting plate 40. The mounting plate 40 is constructed so that the upper edge 41 thereof follows the configuration of the slot 13. A hole 401 is provided at a suitable position on the mounting plate 40 for locking engagement with the cylindrical locking member 32 of the catch means 30. To insert the roller assembly the catch means 30 is pulled and held manually out of the slot 13 whereupon the mounting plate 40 may be inserted until the upper edge 41 thereof is flush with the top of the groove 13, as shown in FIG. 2. The catch means 30 is then released, whereupon the force of the spring 34 will cause the locking member 32 to enter and extend beyond the hole 401. In this way the roller assembly is locked into place within the shoe body 10.

According to one embodiment of a roller assembly, the rollers 50 are provided on shafts 43. Said shafts 43 extend beyond the edge of the shoe body on each side thereof and are contained in generally "U" shaped support casings 44. Said casings 44 are flat across the top and are flush with the sole 20 of the shoe when the roller assembly is in it correct position in the slot 13.

The mounting plate 40 is also provided at each end with an extending portion 42 which is also flush against the sole 20 of the shoe body 10 to provide better support. In this way the weight of the user is distributed uniformly along the upper edge 41 of the mounting plate 40 and the bottom of the groove 13, along the extended portions 42, as well as along the flat upper portions of the support casings 44.

As a safety feature, a stop 46 of a suitable material may be secured to both the front and rear extended portions 42 to enable the user to stop safely even when skating at high speeds.

Figure 4B:
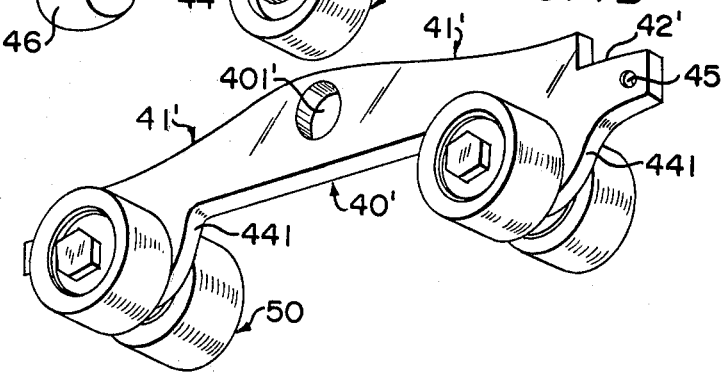
FIG. 4B is a similar view of a second embodiment thereof.
Figure 4C:
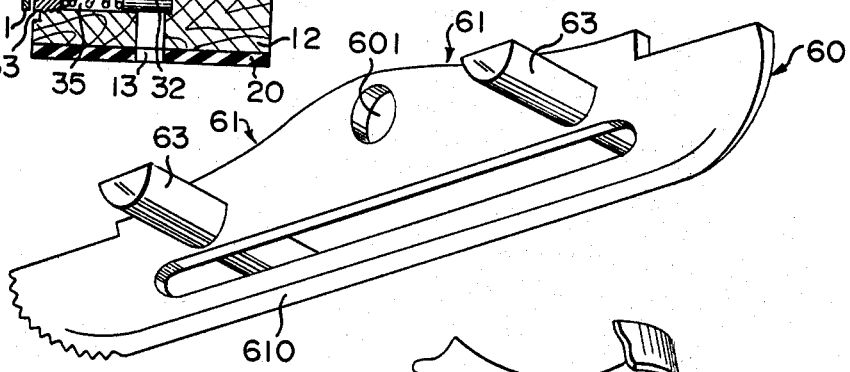
FIG. 4C is a similar view of an ice skating means according to the present invention.

As shown in FIG. 4B, according to a second embodiment of the roller assembly, the rollers 50 may be rotably secured to protruding portions 441 of the mounting plate 40' so that the rollers 50 are not in contact with the sole 20 of the shoe body 10 and are free to rotate. In this embodiment the rollers are provided along the central portion of the bottom of the shoe so that more dexterity is required when skating, thus creating a different skating effect. Rubber stops may also be used with this embodiment by attaching them by means of a screw through a hole 45 provided at both the forward (not shown) and rear portions thereof.

According to a combination shoe and skate as disclosed, it is possible to employ a wide variety of skating means of various designs, including a blade 60 for ice skating, as shown in FIG. 3C. The ice skating blade 60 consists of a mounting plate in the same configuration as the preceding embodiments, having upper support edges 61 and a suitable hole 601 for engagement with the catch means 30 of the shoe body 10. The lower portion of the mounting plate is extended and formed in a suitable configuration for skating on ice. To provide better support, semi-round support posts 64 in the same general configuration as the support casings 44 of a previous embodiment may be formed integrally with the mounting plate. The support posts 63 have flat upper surfaces which fit flush against the sole 20 of the shoe 10 and extend transversly across the sole 20 of the shoe 10 on either side of the skate 60, providing the necessary support and stability required to skate.

Figure 5:
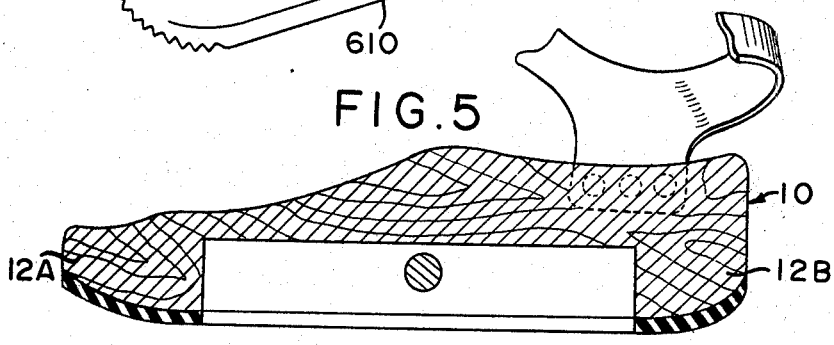
FIG. 5 is a second embodiment of the shoe body of FIG. 1.

Of course, the style of the shoe body itself may be subject to many various designs. For example, to provide more comfortable walking when the skating means are not in use, the shoe 10 may be provided with an inclined toe portion 12A and a slightly rounded heel portion 12B as shown in FIG. 5.

In this way there is provided a shoe that is suited for walking in the normal fashion and which, in conjunction with various interchangeable skating means of the type disclosed above, may be used for roller skating, ice skating and the like. It will be noted that skating means will be subject to a great variety of designs without leaving the scope of the present invention and should be restricted only by the claims heretofollow.

What I claim is:

1. A construction for a shoe adapated for selective use with one of a plurality of skating means, comprising:

a sole having a side, forward and rear ends and a longitudinal slot defined therein, said slot being spaced from said sole forward and rear ends;

a catch means fixed on said sole and including a bore extending transversely of said sole from said sole side and connecting with said longitudinal slot, a locking member slidably positioned within said bore and movable from a locking position extending transversely across said slot obstructing said slot into an unlocking position to one side of said slot, yieldable means urging said locking member into said locking position, and operating means connected to said locking member and located outside of said bore for moving said locking member into said unlocking position against the urging force of said yieldable means; and a mounting plate on a skating means and dimensioned to be received in said slot for detention therein and having a locking hole defined therein for receiving said locking member to attach said mounting plate to said sole whereby a skating means is attached to the shoe when said locking member is in said locking position.

2. The construction for a shoe as claimed in claim 1 wherein said slot is generally arcuate through the central portion thereof and generally flatter at both ends.

3. The construction for a shoe body as claimed in claim 2 wherein the toe portion of the shoe is inclined and the heel portion thereof is rounded.

4. The construction for a skating means as claimed in claim 1 wherein the bottom portion of said mounting plate is formed as an ice skating blade, said mounting plate also having suitable support means extending from each side thereof, said support means being semi-circular in cross section and extending for substantially the width of the sole of the shoe.

5. A construction for a shoe adapted for selective use with one of a plurality of skating means and the construction of a shoe means characterized in that a suitable slot is provided in the bottom portion of said shoe running longitudinally along the bottom and being spaced from the ends thereof, an operable catch means adapted for holding a skating means in position being provided in said shoe running transversely to and communicative with said slot, a mounting plate on a skating means in the general configuration of said slot and being detainable therein by means of a suitable locking hole through which said catch means may engage the mounting plate, said mounting plate being in the general configuration of said slot in the bottom of said shoe and including a generally arcuate configuration in the central portion thereof with said locking hole being located under said arcuate configuration, the bottom portion of a skating means being adapted for supporting a plurality of rollers.

6. The construction for a skating means as claimed in claim 5 wherein said of said plurality of rollers is secured to one end of an axle being mounted through said bottom portion of the skating means and extending beyond the outermost edges of the bottom portion of the shoe, and further having provided therearound for substantially the length thereof a casing, said casing being semi-circular in cross section with a flat upper surface which fits flush against the sole of the shoe.

7. The construction for a skating means as claimed in claim 5 wherein a skating means includes an extended portion at each end fitting flush against and extending longitudinally along the sole of the shoe, and a suitable rubber stop provided on each extended portion.

* * * * *